United States Patent [19]

Choi et al.

[11] Patent Number: 4,763,045

[45] Date of Patent: Aug. 9, 1988

[54] SPARK IGNITOR GENERATED BY CAPACITOR DISCHARGE SYNCHRONIZED WITH ALTERNATE CURRENT POWER FREQUENCY

[75] Inventors: Hyeong In Choi, Evanston, Ill.; Keh-Kun Choi, Seoul, Rep. of Korea

[73] Assignee: Bang H. MO, Chicago, Ill.

[21] Appl. No.: 45,284

[22] Filed: May 4, 1987

[51] Int. Cl.[4] ..... F02P 3/06

[52] U.S. Cl. ..... 315/209 SC; 315/209 CD; 315/218; 315/240; 123/605

[58] Field of Search ..... 315/209 CD, 218, 209 SC, 315/240; 123/599, 198 DC, 630, 605

[56] References Cited

U.S. PATENT DOCUMENTS

| | | | |
|---|---|---|---|
| 3,049,642 | 8/1962 | Quinn | 315/209 CD |
| 4,001,638 | 1/1977 | Bauer et al. | 315/209 CD |
| 4,515,139 | 5/1985 | Ledger | 315/209 CD |

*Primary Examiner*—David K. Moore
*Assistant Examiner*—Mark R. Powell
*Attorney, Agent, or Firm*—Birch, Stewart, Kolasch & Birch

[57] ABSTRACT

An apparatus for the generation of ignition power and its circuits is composed of two transformers and one discharging capacitor. The triggering signal is taken from the alternating current supply voltage. The stored charge is discharged through a primary winding of a step-up transformer. The secondary voltage is stepped up to several ten thousand peak volts which is enough to make an ignition spark through a large air gap. The first half wave of alternating current power charges the capacitor and the second half wave triggers an SCR to discharge the capacitor. The charging and discharging are completed during a single period of a line power wave.

8 Claims, 2 Drawing Sheets

SPARK IGNITOR GENERATED BY CAPACITOR DISCHARGE SYNCHRONIZED WITH ALTERNATE CURRENT POWER FREQUENCY

BACKGROUND OF THE INVENTION

The present invention relates to an apparatus for generating ignition power with higher power efficiency.

The conventional and widely used ignition apparatus is a simple step-up transformer which generates a secondary transformer winding voltage of approximately 10,000 volts. However, this type of ignition transformer may not produce an ignition spark for a spark gap wider than a half inch. Furthermore, this type of ignition transformer draws a sufficiently large amount of primary current. This current normally causes heat accumulation inside the transformer housing. For this reason, the conventional type of ignition transformer may not ensure satisfactory operation over an extended period of time. Also, in the worst case, if the high voltage secondary winding coil is short circuited through the ignition spark gap, the widely used conventional ignitor consisting of a single transformer, will be burned out eventually without fail.

In conventional ignition systems including a single step-up transformer, the power delivered to the spark gap is a function of the spark gap distance. Thus, a fairly large transformer is required even for a one-half inch spark gap.

Consequently, a need in the art exists for an improved ignition system which overcomes the above-described problems.

SUMMARY OF THE INVENTION

Accordingly, it is a primary object of the present invention to provide an ignition circuit and method wherein the power delivered to the spark gap is constant over a wide range of spark gap distances up to about three inches, to facilitate the use of smaller step-up transformers than required heretofore.

It is another object of the present invention to provide an ignition circuit which generates minimum heat within the step-up transformer housing.

It is a further object of the present invention to provide an ignition circuit which will not be damaged caused by a short circuited spark gap.

These and other objects of the present invention are fulfilled by providing an apparatus for generating an ignition spark across a spark gap comprising:

(a) charge storage means having circuit charging means and discharging circuit means, said charge storage means generating said ignition spark when discharging;

(b) a source of sinusoidal alternating current power for generating successive positive and negative half waves of power;

(c) means for applying a selected half wave of said power to the charging circuit of said charge storage means to charge the same to a peak voltage; and (d) means for applying the next successive half wave following said selected half wave to the discharging circuit of said charge storage means, said next successive half wave generating a trigger signal to discharge said charge storage means and generate said ignition spark.

The ignition circuit and method of the present invention has many advantages over conventional type circuits. With the circuit of the present invention, the power delivered to the spark ignition gap is constant and not a function of the spark gap distance. The power supplied to the output circuit of c f [Joules per second] or cdf [watts], where c is the capacitance in which electric charge is stored with a voltage difference of V [volts]. And charge and discharge is repeated at the same rate as the power supply frequency of f(Hertz). The discharge time length is very short compared with a period of sinusoidal commercial power wave. This means that the energy dissipation rate, or the instantaneous dissipation power, is very large during the period when ignition occurs.

An additional advantage is that the ignition system of the present invention will never be burned out caused by a short circuited spark gap, since it delivers a constant rate of energy to an output circuit.

In addition, according to the present invention, a discharging current flows through the primary winding of a step-up transformer with a rapid discharge. This results in the advantage that a step-up transformer with a smaller size can handle a relatively large amount of power. With the present invention, the spark gap distance can easily be extended to a few inches.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENT

Figure 3:
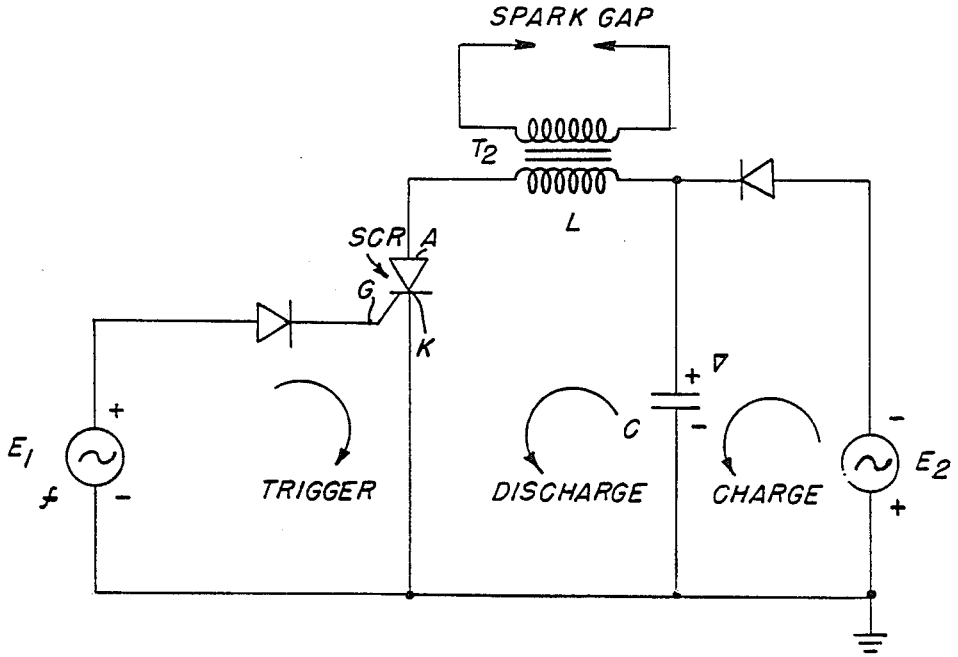
FIG. 3 is a diagrammatic illustration further explaining the operation of the circuit of FIG. 1.

The present invention will become more fully understood with reference to FIG. 3. Sinusoidal voltages $E_1$, and $E_2$ are out of phase, and during the time when the charging current flows through the capacitor C, no triggering current flows. But after the capacitor is charged to a peak voltage level of $E_2$, this voltage level is held until the capacitor C is triggered to discharge caused by triggering gate current at gate G of the SCR. This triggering current starts to flow when $E_1$ becomes positive and $E_2$ shows negative polarity. This negative voltage helps the SCR to be turned off when the oscillation LC current in the primary winding of step-up transformer $T_2$ tends to flow in a reverse direction. The diaphragm of FIG. 3 thus shows the general operation and method of the present invention which is performed by the preferred embodiment of the present invention illustrated in FIG. 1.

Figure 1:
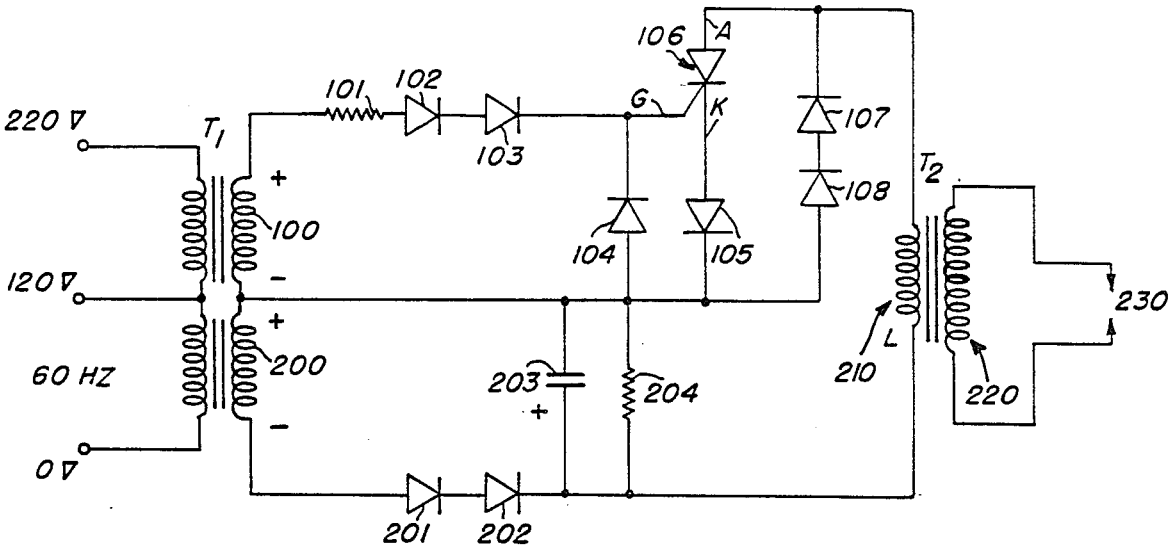
FIG. 1 is a circuit schematic of a preferred embodiment of the ignition system of the present invention.

Referring now to FIG. 1, $T_1$ is a simple power transformer with an input voltage of 220 volts with a center tap for an input voltage of 120 volts. The secondary winding 100 supplies a triggering current through diodes 102 and 103. The resistor 101 limits the gate current to a safe level. The diode 105 raises the triggering voltage level of the SCR 106. Another secondary winding 200 supplies a positive charge to a charge storage device such as a capacitor 203. The diodes 201 and 202 rectify the alternating current to make it unidirectional.

After capacitor 203 is charged to a peak voltage, the triggering voltage is built up by the winding 100 to a sufficient level to fire the SCR 106. At this moment, the capacitor 203 discharges through the step-up transformer $T_2$, and discharging current flows through primary winding L 210, SCR 106 and diode 105. The LC oscillatory current from primary winding L charges the capacitor 203 inversely. The fully inversely charged voltage upon capacitor 203 tends to flow from the cathode K to anode A of the SCR 106. This current turns off the SCR 106, completely, with the addition of the negatively polarized secondary voltage. The diodes 107 and 108 dissipate the negative charge at the capacitor 203. The resistor 204 discharges the capacitor when the power is in the OFF state.

The secondary winding 220 supplies a high voltage igniting energy to a spark gap 230. The diodes 201 and 202 rectify the alternating current to charge the capacitor 203.

The diode 104 is a safety device which prevents the development of an excessive negative voltage upon gate G to cathode K of SCR 106.

Figure 2A:
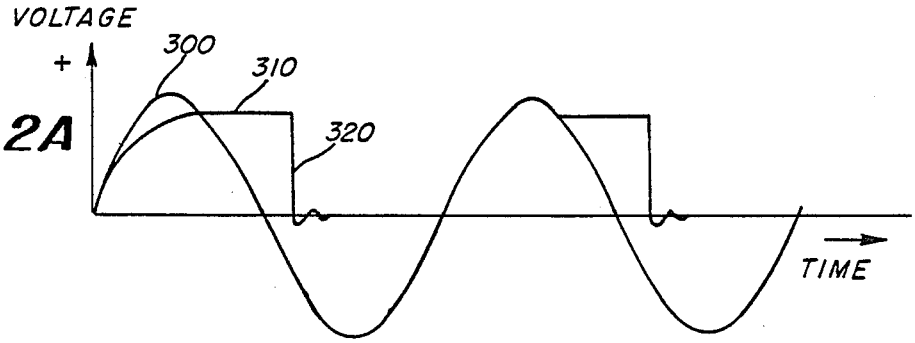
FIGS. 2A, 2B and 2C are waveforms explaining the operation of the circuit of FIG. 1.
Figure 2B:
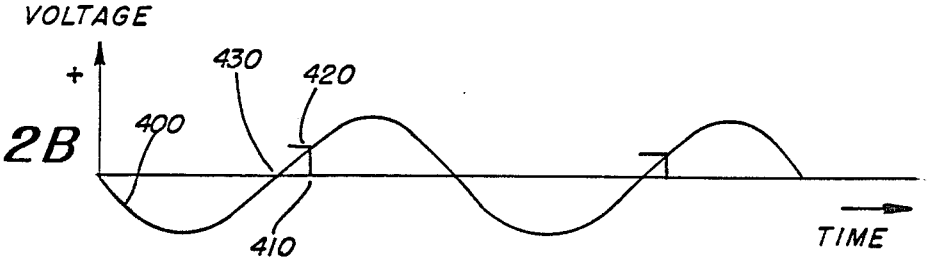
Figure 2C:
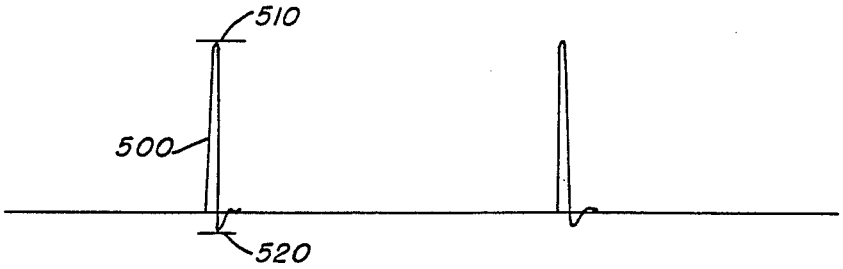

The operation of the circuit of FIG. 1 may be better understood by refernece to FIG. 2. A sinusoidal wave 300 may be a 60 Hz, 50 Hz, or any other power supply wave frequency. The wave 310 is a capacitor voltage across capacitor 203 which is charged up to a peak value of the positive half wave and rapidly falls down when it is triggered to discharge through the SCR 106. It shows a damped oscillation, as shown by 320.

Another sinusoidal wave 400 acts to trigger the SCR 106. This wave is shown to be out of phase compared to the wave of 300. The point 430 is a zero cross over point. The wave 400 rises to a positive value, after it reaches a threshold level 420 to trigger the SCR 106. The triggering instant is denoted as 410.

The impulse wave developed upon the secondary winding 220 is schematically shown by 500. The top level 510 may be extended to a few ten thousand volts. The bottom level 520 exhibits a damped oscllation. The instantaneous discharge will produce a high density of energy dissipation, so that sparking current can flow through the medium of air over a wide spark gap of up to about 3 inches.

While an SCR 106 has been disclosed as the solid state switch in the preferred embodiment of FIG. 1, it should be understood that other solid state switches such as a TRIAC, a GTD (gate turn off device) or power MOS FETs may also be used.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. Apparatus for generating an ignition spark across a spark gap comprising:

(a) charge storage means having charging circuit means and discharging circuit means, said charge storage means generating said ignition spark when discharging;

(b) an input transformer having a center tap defining first and second primary windings and first and second secondary windings, said first and second primary windings being coupled to said source of alternating current, one of said secondary windings being coupled to the charging circuit means of said charge storage means for supplying charging current thereto, and the other of said secondary windings being coupled to the discharging circuit means of said charge storage means to generate said trigger signal;

(c) a source of sinusoidal alternating current power for generating successive positive and negative half waves of power;

(d) means for applying a selected half wave of said power to the charging circuit of said charge storage means to charge the same to a peak voltage; and (e) means for applying the next successive half wave following said selected half wave to the discharging circuit of said charge storage means, said next successive half wave generating a trigger signal to discharge said charge storage means and generate said ignition spark.

2. Apparatus according to claim 1 wherein said discharging circuit means includes solid state switch means through which said charge storage means discharges when said solid state switch means is turned ON, said solid state switch means being turned ON in response to application of said trigger signal thereto.

3. Apparatus according to claim 2 wherein said solid state switch means is a silicon controlled rectifier.

4. Apparatus of claim 3 further including output transformer means having a primary winding in the discharging circuit means of the charge storage means and a secondary winding in circuit with said spark gap.

5. Apparatus according to claim 1 further including output transformer means having a primary winding in the discharging circuit means of the charge storage means and a secondary winding in circuit with said spark gap.

6. Apparatus according to claim 2 further including output transformer means having a primary winding in the discharging circuit means of the charge storage means and a secondary winding in circuit with said spark gap.

7. Apparatus according to claim 1 further including output transformer means having a primary winding in the discharging circuit means of the charge storage means and a secondary winding in circuit with said spark gap.

8. A method for generating an ignition spark across a spark gap comprising the steps of:

(a) providing charge storage means having charging circuit means and discharging circuit means, said charge storage means generating said ignition spark when discharging;

(b) Providing an input transformer having a center tap defining first and second primary windings and first and second secondary windings, said first and second primary windings being coupled to said source of alternating current, one of said secondary windings being coupled to the charging circuit means of said charge storage means for supplying charging current thereto, and the other of said secondary windings being coupled to the discharging circuit means of said charge storage means to generate said trigger signal;

(c) providing a source of sinusoidal alternating current power for generating successive positive and negative half waves of power;

(d) applying a selected half wave of said power to the charging circuit of said charge storage means to charge the same to a peak voltage; and (e) applying the next successive half wave following said selected half wave to the discharging circuit of said charge storage means, said next successive half wave generating a trigger signal to discharge said charge storage means and generate said ignition spark.

* * * * *